United States Patent [19]

Catania

[11] Patent Number: 4,611,609

[45] Date of Patent: Sep. 16, 1986

[54] HAIR CURLER

[76] Inventor: Samuel J. Catania, 2123 Rodeo Ct., Thousand Oaks, Calif. 91362

[21] Appl. No.: 689,363

[22] Filed: Jan. 3, 1985

[51] Int. Cl.[4] ..... A45D 2/00

[52] U.S. Cl. ..... 132/38 R; 132/40; 132/43 A

[58] Field of Search ..... 132/38 R, 39, 40, 43 R, 132/43 A

[56] References Cited

U.S. PATENT DOCUMENTS

| | | | |
|---|---|---|---|
| 1,571,317 | 2/1926 | Brettschneider | 132/38 R |
| 2,452,456 | 10/1948 | Grant | 132/41 R |
| 2,579,204 | 12/1951 | Renstrom | 132/35 |
| 2,611,376 | 9/1952 | McIntyre | 132/38 R |
| 2,760,499 | 8/1956 | Taylor | 132/43 R |
| 2,962,031 | 11/1960 | Bumgarner | 132/40 |
| 3,034,515 | 5/1962 | Fulco et al. | 132/43 R |
| 3,108,603 | 10/1963 | Mobberley | 132/40 |
| 3,123,081 | 3/1964 | Vaughn | 132/41 R |
| 3,444,864 | 5/1969 | Glushakow | 132/38 R |
| 3,590,829 | 12/1968 | Parisi | 132/43 R |
| 3,605,763 | 9/1971 | Fusco | 132/41 A |
| 3,653,392 | 4/1972 | Hassey et al. | 132/41 R |
| 3,756,255 | 9/1973 | Solomon | 132/43 R |

*Primary Examiner*—John J. Wilson

*Attorney, Agent, or Firm*—Henderson & Sturm

[57] ABSTRACT

An improved hair curler construction (10) for use in combination with the narrow pointed end (21) of a hair care tool (20), wherein the curler construction (10) comprises a curler body (11) having a tapered upper lip portion (12) and an outwardly projecting lower lip portion (13).

1 Claim, 6 Drawing Figures

HAIR CURLER

TECHNICAL FIELD

The present invention relates generally to the field of hair care or grooming apparatus.

BACKGROUND OF THE INVENTION

The prior art is replete with diverse hair curler constructions, as is evidenced by U.S. Pat. Nos. 3,653,392; 3,605,763; 2,452,456; and 3,123,081.

While all of the aforementioned prior art apparatus are adequate for their intended purposes, it is fairly obvious simply by virtue of the large number of patented structures in this area of technology, that the previous structures were deficient in a number of respects, and, also that there was room for improvement and refinement over the existing device.

The realization of this fact prompted attempts to develop a new and improved hair curler construction and the ultimate result of those attempts are embodied in the structure that forms the basis of the present invention.

SUMMARY OF THE INVENTION

The present invention comprises a generally cylindrical hair curler body having an inwardly tapered upper lip portion and an outwardly projecting rounded lower lip portion. The outwardly projecting ends of the lower lip portion form cliffs that support and guide the narrow end of a rattail comb to facilitate the insertion of the user's hair into the interior of the curler structure.

BRIEF DESCRIPTION OF THE DRAWINGS

These and other objects, advantages, and novel features of the invention will become apparent from the detailed description of the best mode for carrying out the invention which follows, particularly when considered in conjunction with the accompanying drawings, wherein.

BEST MODE FOR CARRYING OUT THE INVENTION

Figure 1:
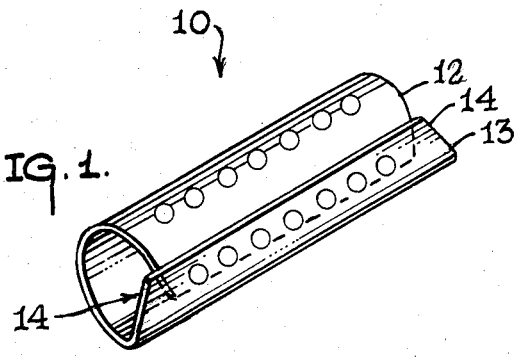
FIG. 1 is a perspective view of the improved hair curler.
Figure 2:
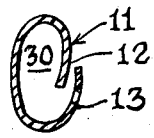
FIG. 2 is an end view of the improved hair curler.
Figure 3:
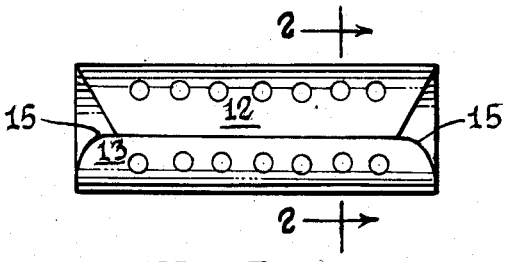
FIG. 3 is a front elevation view of the improved hair curler.
Figure 4:
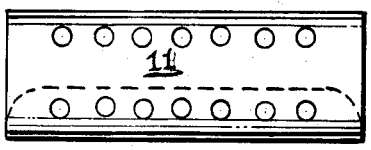
FIG. 4 is a rear elevation view of the improved hair curler.

As can be seen by reference to FIG. 1, the hair curler construction that forms the basis of the present invention is designated generally by the numeral (10).

The hair curler construction (10) comprises an apertured curler body member (11) having an overlapping generally C-shaped cross-sectional configuration. In addition, the curler body member (11) is provided with a tapered upper lip portion (12), and an outwardly projecting lower lip portion (13).

The outwardly projecting lower lip portion (13) has a width substantially greater than the tapered upper lip portion (12). In addition, the ends (14) of the lower lip portion (13) extend a substantial distance beyond the sides of the upper lip portion (12) to form cliff surfaces (15), that are used to guide and support a narrow tool (20), used in combination with the improved hair curler construction (10).

Figure 5:
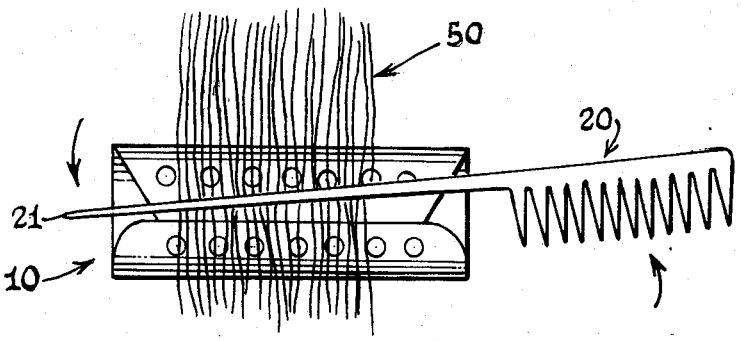
FIG. 5 is a view of the hair curler as it would appear prior to the insertion of hair; and, FIG. 6 is a view of the improved hair curler being used in conjunction with a rattail comb.
Figure 6:
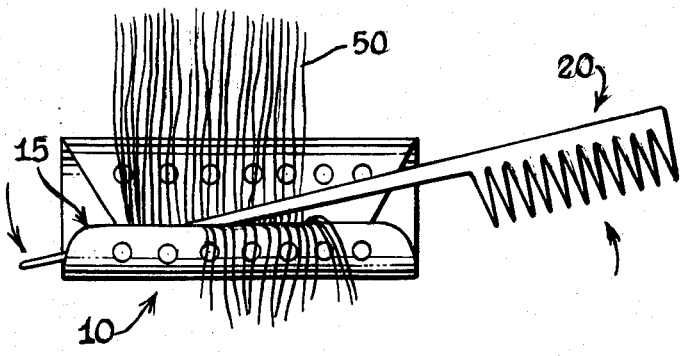

As can best be seen by reference to FIGS. 5 and 6, the tool (20) contemplated for use in conjuction with the improved curler construction (10) comprises the narrow pointed end (21) of a rattail comb or similar instrument. The improved curler construction (10) is disposed adjacent strands of hair (50) that are intended to be engaged by the roller body (11). The pointed end (21) of the tool (20) is placed on the cliff (15) on the lower lip portion (13) and then the tool (20) is inserted between the upper and lower lip portions (12) (13) to force the ends of the strands of hair (50) into the interior of the curler body (11). Once the strands of hair (50) have been wedged between the upper and lower lip portions, the pointed end of the tool is withdrawn through the hollow interior (30) of the curler body.

While the present invention may look very simple, the relative dimensioning of the upper and lower lip portions produces a unique cooperation with the narrow pointed end (21) of a hair care tool (20), which allows the user to quickly and simply capture strands of hair in the curler body. The end result of this cooperation between the respective elements and the unique design employed, transforms a normally onorous task into a relatively quick and simple procedure.

Having thereby described the subject matter of this invention, it should be obvious that many substitutions, modifications, and variations of the invention are possible in light of the above teachings. It is therefore to be understood that the invention as taught and described herein, is only to be limited to the extent of the breadth and scope of the appended claims.

I claim:

1. An improved hair curler construction in combination with an elongated, pointed narrow tool; wherein, the improved hair curler consists of :

an apertured generally cylindrical curler body member having an overlapping generally C-shaped cross-sectional configuration and provided with a tapered upper lip portion, and an outwardly projecting lower lip portion; wherein, the lower lip portion has a width substantially greater than the width of the upper lip portion; the ends of the lower lip portion extend a substantial distance beyond the sides of the upper lip portion; and, wherein, the ends of the lower lip portion form cliff surfaces, that support and guide the insertion of the said pointed narrow tool into the hollow interior of the curler body, for the purpose of forcing the users hair within the confines of said curler body member.

* * * * *